US005190091A

United States Patent [19]

Revankar

[11] Patent Number: 5,190,091

[45] Date of Patent: Mar. 2, 1993

[54] METHOD OF IMPREGNATION OF ALUMINUM ALLOY WITH A WEAR-RESISTANT MATERIAL

[75] Inventor: Gopal S. Revankar, Moline, Ill.

[73] Assignee: Deere & Company, Moline, Ill.

[21] Appl. No.: 564,185

[22] Filed: Aug. 8, 1990

[51] Int. Cl.[5] ..... B22D 19/00

[52] U.S. Cl. ..... 164/97; 164/10; 164/112

[58] Field of Search ..... 164/97, 34, 35, 9, 10, 164/11, 112

[56] References Cited

U.S. PATENT DOCUMENTS

| | | | |
|---|---|---|---|
| 1,057,069 | 3/1913 | MacDonald | 164/10 |
| 1,978,319 | 10/1934 | Mowery | 164/112 |
| 2,303,046 | 11/1942 | Havlick | 164/112 |
| 4,774,991 | 10/1988 | Holden | 164/97 |

FOREIGN PATENT DOCUMENTS

| | | | |
|---|---|---|---|
| 51-25211 | 7/1976 | Japan | 164/97 |
| 58-209466 | 12/1983 | Japan | 164/97 |
| 59-76656 | 5/1984 | Japan | 164/112 |

*Primary Examiner*—Kurt C. Rowan
*Assistant Examiner*—Rex E. Pelto
*Attorney, Agent, or Firm*—Burns, Doane, Swecker & Mathis

[57] ABSTRACT

A method for impregnating an aluminum product with a hard wear resistant surface area comprises providing a desired pattern of particles thereon, providing a sand core which has an high temperature adhesive layer on at least a portion thereof and transferring the pattern of particles onto the adhesive layer, in such a manner so as to minimize contact with the adhesive. After the adhesive is cured, an aluminum melt is cast around the carbides so as to produce an aluminum product having a wear resistant material surface layer. Preferably, the aluminum alloy contains about 4% by weight of copper and the wear resistant material comprises tungsten carbide containing 12 wt. % Co. In one embodiment, the particles are transferred onto the adhesive layer through the use of an adhesive tape which is used to pick up the pattern of particle and then placed upon the adhesive layer on the core surface.

16 Claims, 2 Drawing Sheets

METHOD OF IMPREGNATION OF ALUMINUM ALLOY WITH A WEAR-RESISTANT MATERIAL

BACKGROUND OF THE INVENTION

The present invention relates to a process for the impregnation of an aluminum alloy with a surface comprising a hard wear-resistant material.

A wide variety of techniques are known for the impregnation of iron with a hard wear-resistant surface. Such techniques include flame spray coating and plasma spray coating. However, each of these spray coating techniques suffer from problems associated with the spalling of surface layers during the coating process and during service as well as the particularly large expense associated with the use of these techniques.

Cast-In-Carbides are also known in which carbide particulate are placed within a mold and molten iron is then cast. See, for example, the discussion within U.S. Pat. No. 4,119,459 to Ekemar et al. It is difficult, however, with such castings to accurately maintain the carbide particles in the desired location and in a regular distribution pattern.

In addition, certain cast-on hard surfacing techniques for use with polystyrene patterns are also known in the art. See, for example, the discussion in Hansen et al, "Application of Cast-On Ferrochrome-Based Hard Surfacings to Polystyrene Pattern Castings," Bureau of Mines Report of Investigations 8942, U.S. Department of the Interior, 1985.

While those methods have been used for the impregnation of iron, they have not heretofore been employed with aluminum alloys. The art has instead made composite materials from aluminum having a cylindrical shape by centrifuging a slurry of molten aluminum and fine carbide particles such that either the metal or the carbides segregate preferentially to the outer circumference of the cylinder so as to yield the higher concentration of that respective phase.

However, such a method would be unsuitable for casting heavy carbides, such as tungsten carbide, whose density is more than five times that of aluminum since it would be impractical to hold these heavy particles in suspension. Furthermore, such a method would not be effective in introducing a hard wear resistant surface into selective areas of the casting as well as casting complex aluminum shapes which are desirably impregnated with a wear resistant material.

Accordingly, the need still exists for a method of impregnating aluminum alloy surfaces with a hard wear-resistant material.

SUMMARY OF THE INVENTION

In one aspect of the present invention, there is disclosed a method for impregnating an aluminum alloy with a hard wear-resistant material surface layer comprising:

(a) providing a mesh plate having a desired pattern of holes of a predetermined size;

(b) spreading particles onto the mesh plate so as to provide a particle in substantially all of the mesh holes;

(c) providing a sand core having a desired shape and a layer of adhesive on at least a portion thereof;

(d) transferring the desired pattern of particles onto the adhesive layer in such a manner so as to minimize contact with the adhesive;

(e) curing the adhesive so as to anchor the particles to the sand core; and (f) casting an aluminum melt around the carbides so as to produce an aluminum product having a wear resistant material surface layer.

In one embodiment, the particles are transferred through the use of an adhesive tape which is placed on the mesh plate after (b) and then placed upon the adhesive layer in step (d) and removed after step (c).

In addition, there is provided the product of this process.

This process can further comprise (g) cooling the product and separating both the adhesive and the core from the aluminum product; and (h) finishing the wear resistant surface.

BRIEF DESCRIPTION OF THE DRAWINGS

FIGS. 2–4*a–d* are photographs illustrating various aspects of the present invention.

DETAILED DESCRIPTION OF THE PREFERRED EMBODIMENTS

Figure 1A:
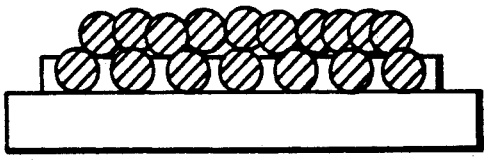
FIGS. 1*a–d* illustrates a technique for forming a particle pattern.
Figure 1B:
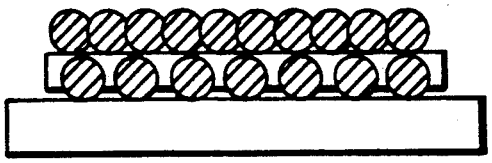
Figure 1C:
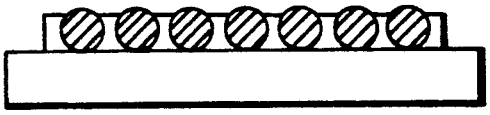
Figure 1D:
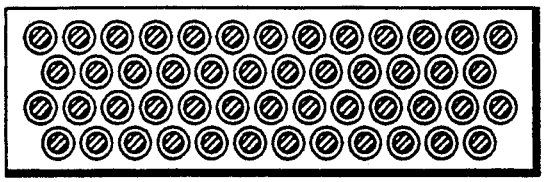

The aluminum alloy which can be employed in the process of the present invention includes any aluminum alloy, however, the alloy preferably contains copper in an amount effective to improve the wettability of the carbide. This copper is preferably present in an amount of at least about 3–5%, most preferably about 4% Cu by weight. Specific examples of such alloys include the AA designation 2XX.X series alloys such as 201.0, 206.0, and the like.

In the present invention, larger particles of the hard wear-resistant material are preferably employed, i.e., those particles having a size of about 2 mm or more. More preferably, the particle size is from about 2 to about 3 mm. Moreover, the size of all the particles in a given bulk is within about 0.5 mm of the median size. However, the use of particles having different sizes can be made to produce layers having a controlled, desired thickness at various points on the final product.

The particles employed are also preferably substantially spherical for ease of use and other practical considerations, although the shape is less critical to the present invention.

As to the choice of the hard wear-resistant material, the present invention can effectively employ any of the hard phases which are traditionally employed with the art, such as tungsten carbide, chromium carbide, and the like, or mixtures thereof provided they are wettable by the molten metal. Furthermore, this material can include a binder metal, such as those in the Fe group, preferably Co for tungsten carbide, or nickel for chromium carbide, etc., which may be necessary to produce the preferred spherical shapes.

A high temperature inorganic adhesive is preferred as the adhesive in order to prevent the premature release of the carbide particles from the core. By high temperature, it is meant that the adhesive has a melting point higher than the aluminum pouring temperature. For example, one example of a preferred adhesive is AREMCO Ceramabond 569 which is a proprietary high temperature adhesive which includes oxides of Al, Si, K in a colloidal suspension in water, and which has a maximum use temperature of about 1650° C. (Ceramabond is a trademark of AREMCO Products, Inc.) Other adhesives which can be employed include various high temperature inorganic adhesives made by other manufacturers, e.g., Cotronics Corporation.

The process of the present invention is used to provide a casting with the wear-resistant material at a particular place (or places) of the casting utilizing an air set (no bake) sand core. The sand core of a particular shape and size (which is dependent upon the ultimate cast product desired) may be produced by any known method. In particular, certain efficacious methods for forming sand cores are illustrated within ASM Metals Handbook, Volume 5, 8th Edition.

Preferably, by the process of the present invention, a single layer of spherical carbide particles is spread on an adhesive layer which has been applied to the core surface. Because the adhesive film on the particle prevents wetting of the particle by the molten metal, there should be a minimum area contact, preferably a single point contact, between the particle and the adhesive. Furthermore, the particles are preferably uniformly distributed on the core, without near neighbor contact, to allow easy metal and slag flow around each particle and thus form a good quality composite, the slag being formed due to interaction between carbides, molten metal and high temperature adhesive.

In order to perform the above objectives, the following procedures can be employed. A mesh plate, e.g., a sheet having a desired pattern of mesh of holes of a predetermined size is provided. Preferably, the mesh plate has a hexagonal pattern of holes in order to provide the optimal packed arrangement. Moreover, the mesh plate thickness is preferably selected to be less than the median particle diameter, more preferably between about ½ and about ¾ of the median particle diameter so that the particles protrude slightly above the mesh plate. In particular, this mesh plate can be provided by any suitable means, e.g., drilling holes, in a steel or plastic (e.g., polycarbonate) sheet having the desired thickness.

After the mesh plate is placed on a flat surface of a support plate, e.g., a steel plate or the like, the particles are then spread on the mesh plate and the excess particles are removed. See, for example, FIG. 1(*a*). This removal can be accomplished by any suitable means, for example, by raising the mesh plate to a height approximately equal to the particle radius and scraping off the excess particles. See, for example, FIG. 1(*b*). The mesh plate is then be lowered onto the flat surface of the support plate so that the top of the particles will protrude above the top surface of the mesh plate, thus forming a geometric pattern of particle distribution. See, for example, FIGS. 1(*c*) and (*d*).

The adhesive layer is applied to the sand core at those locations where the wear resistant layer is to be provided. The adhesive layer can be applied to the sand core by any suitable means, e.g., painting. The adhesive layer preferably has a thickness of at least about 0.1 mm, more preferably about 0.1 to 0.5 mm, still more preferably 0.2 to 0.5 mm.

Figure 2:
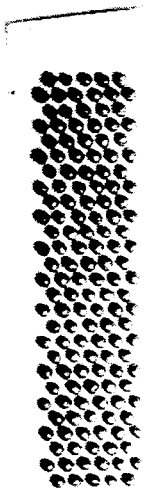

At this point, the pattern of particles are transferred to the adhesive layer on the sand core. In one embodiment, an adhesive tape is placed on the particle pattern. When the adhesive tape is removed, the geometric pattern of particles is effectively transferred from the mesh plate to the adhesive tape. See, for example, FIG. 2.

The tape is then placed on the adhesive layer so that the carbide particles make minimum contact with the adhesive. The tape may be moved without disturbing the particle arrangement or increasing the adhesive/particle contact area until the adhesive has not cured. This freedom allows precise location of the tape onto the core. Hot air may be blown for a sufficient period of time, e.g., 25–30 seconds, onto the tape in order to allow the adhesive to be sufficiently dry to hold it in place and allow handling the core without disturbing the tape with the particle arrangement.

Figure 3:
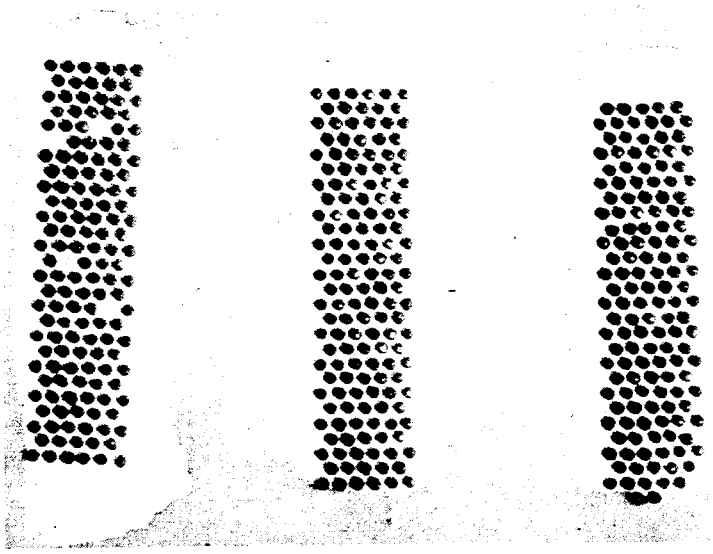

The adhesive is then cured. If, for example, Ceramabond 569 is employed, this occurs at room temperature in 16 hours or at 50° C. in 8 hours. When the adhesive is cured, the tape can be removed. This leaves a pattern of carbide particles firmly anchored to the core surface. See, for example, FIG. 3.

The tape which can be employed in the present invention includes any tape strong enough to hold heavy, i.e., high density, carbides firmly in place and yet weak enough to release the particles when the tape is lifted off the carbide strip after curing of the adhesive. Specific examples of such tape include 3M 404 type tape with high tack rubber adhesive, and 3M 9415 or Y928 low tack tapes with acrylic type adhesives.

In addition, in an alternative embodiment, if a polymer sheet, e.g., polycarbonate sheet with mesh patterns, such as those manufactured by Plascore, Inc., is employed, it is flexible enough to be used for carbide distribution directly on a core without using tape. In this alternate process, adhesive is applied to the core surface, the mesh sheet is placed on the adhesive layer, particles are spread on the mesh sheet and mesh sheet is lifted off core surface after the adhesive is cured. Mesh size is chosen such that only one particle can enter a given mesh. However, if large or complex surfaces are to be produced, the tape method is preferred.

At this point the liquid aluminum is cast around the carbide through any of the casting techniques traditionally employed in the art, e.g. gravity feed casting, squeeze casting vacuum casting, and the like. However, due to ease of use, the gravity feed of metal is preferred.

Figures 4A, 4B, 4C, 4D:
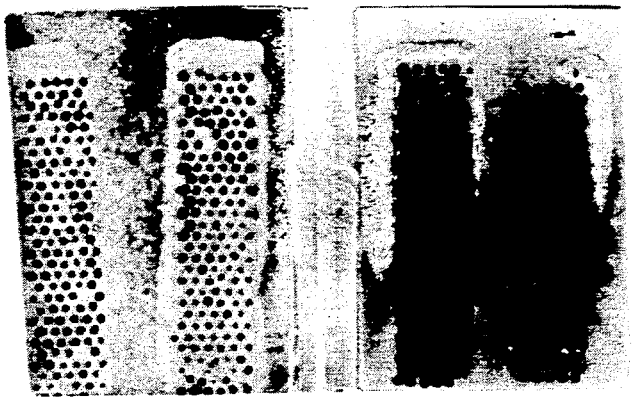

Exemplary aluminum castings are illustrated in FIG. 4. In FIG. 4(*a*) and (*b*), copper coated and plain carbides, respectively, are shown as cast. In FIG. 4(c) and (d), the copper coated and plain carbides have been ground.

The method according to the present invention can be used to make aluminum products which have a wide variety of applications. In particular, the procedure can be used for making complex components with wear surfaces such as rotor housing. Moreover, this can be accomplished at a greatly reduced cost when compared to prior art systems.

In addition to the ease associated with various aspects of the present invention, e.g., the use of sand cores, the use of adhesive tapes which allow application to a variety of curved and complex core surfaces, the use of geometric, regular particle arrangement which aid in assuring particle entrapment by the metal, the method of the present invention can produce a composite which has a regular particle pattern can as well as uniform tribological characteristics over the entire composite surface.

In order to further illustrate the present invention and the advantages associated therewith, the following specific example is given, it being understood that same is intended only as illustrative and in nowise limitative.

EXAMPLE

A powder consisting of spherical particles having a median diameter of about 2 mm and whose diameters do not vary from the median by more than 0.5 mm, is spread on a mesh plate having hexagonal pattern of holes. The sheet thickness is slightly greater than approximately the median particle radius.

The mesh plate is raised above a support steel plate through a height approximately equal to the particle radius and the excess particles are scraped off. The sheet is then lowered back onto the plate so that the top of the particles protrude above the top surface of the sheet.

Adhesive tape comprising 3M 404 type tape is placed on the particle pattern, pressed lightly and lifted off to transfer the particle pattern to the tape.

A layer of approximately 0.1 to 0.25 mm thickness of Ceramabond 569 adhesive is painted onto a sand core of the desired shape and the tape is placed thereon so as to make single point contact with the adhesive.

The adhesive is cured for 8 hours at 50° C. and the tape peeled off after the core is cooled, preferably to room temperature.

The liquid aluminum with 4% by weight copper is cast around the carbide particles to produce a casting having a composite layer.

After the casting is cooled, the high temperature adhesive along with the core is easily separated from the carbides in the casting surface.

While this invention has been described in terms of various preferred embodiments, the skilled artisan will appreciate the various modifications, substitutions, omissions and changes which may be made without departing from the spirit thereof. Accordingly, it is intended that the scope of the present invention be limited solely by the scope of the following claims including equivalents thereof.

What is claimed is:

1. A method for impregnating an iron product with a hard wear-resistant material surface layer comprising:

(a) providing a pattern of particles arranged in a mesh plate;

(b) providing a sand core having a desired shape which has a first layer of adhesive on at least a portion thereof;

(c) placing a tape having a second adhesive layer onto the mesh plate so as to transfer the pattern of particles from the mesh plate onto the second adhesive layer and then placing the tape upon the first adhesive layer in a manner so as to minimize contact with the first adhesive layer;

(d) curing the first adhesive layer so as to anchor the particles to the sand core and then removing the tape; and (e) casting an aluminum melt around the particles so as to produce an aluminum product having a wear-resistant material surface layer.

2. The method according to claim 1 wherein the pattern of particles in (a) obtained by (i) providing a mesh plate having a desired pattern of holes of a predetermined size;

(ii) spreading particles on the mesh plate so as to provide a particle in substantially all of the holes.

3. The method according to claim 2 wherein the particles are spherical particles having a mean diameter of at least about 2 mm.

4. The method of claim 3 wherein the particles have a mean diameter of at least about 2 mm or about 3 mm.

5. The method according to claim 4 wherein the diameter of each of the particles is within about 0.5 mm of the median diameter.

6. The method according to claim 2 wherein the mesh plate thickness is between about ½ and about ¾ of the median diameter of the particles.

7. The method according to claim 2 wherein said aluminum product comprises an aluminum alloy containing about 4% by weight of copper.

8. The method according to claim 2 wherein the wear resistant material comprises tungsten carbide.

9. The method according to claim 8 wherein the tungsten carbide includes about 12 wt. % Co.

10. The method according to claim 2 wherein the adhesive comprises a high temperature adhesive.

11. The method according to claim 10 wherein the high temperature adhesive comprises an inorganic high temperature adhesive.

12. The method according to claim 2 further comprising (f) cooling the product and separating both the adhesive and the core from the aluminum product and (g) finishing the hard wear-resistant surface.

13. A method for impregnating an aluminum product with a hard wear-resistant material surface layer comprising:

(a) providing a sand core having a desired shape which is a layer of adhesive on at least a portion thereof;

(b) placing a flexible mesh plate having a desired pattern of holes of a predetermined size on the adhesive layer;

(c) spreading particles on a mesh plate so as to provide a particle in substantially all holes wherein the mesh plate and particles are selected such that the particles have minimal contact with the adhesive;

(d) curing the adhesive so as to anchor the particles to the sand core;

(e) removing the mesh plate; and (f) casting an aluminum melt around the particles so as to produce an aluminum product having a wear-resistant material surface layer.

14. The method according to claim 13 wherein the particles are spherical particles having a mean diameter of at least about 2 nm and the mesh plate has a thickness between about ½ and about ¾ of the median diameter of the particles.

15. The method according to claim 13 wherein the wear-resistant material comprises tungsten carbide and the adhesive comprises a high temperature adhesive.

16. The method according to claim 13 further comprising:

(g) cooling the product and separating both the adhesive and the core from the aluminum product; and (h) finishing the wear-resistant surface.

* * * * *